US005777655A

United States Patent [19]

Imai

[11] Patent Number: 5,777,655

[45] Date of Patent: Jul. 7, 1998

[54] THERMAL RECORDING DEVICE

[75] Inventor: Shinji Imai, Kanagawa-ken, Japan

[73] Assignee: Fuji Photo Film Co., Ltd., Kanagawa, Japan

[21] Appl. No.: 677,213

[22] Filed: Jul. 9, 1996

[30] Foreign Application Priority Data

Jul. 10, 1995 [JP] Japan ..... 7-173370

[51] Int. Cl.[6] ..... B41J 2/44; B41J 2/38

[52] U.S. Cl. ..... 347/187; 347/224

[58] Field of Search ..... 347/224, 187, 347/212; 400/120.13, 120.18

[56] References Cited

U.S. PATENT DOCUMENTS 5,021,805 6/1991 Imaizumi et al. ..... 347/187

5,553,951 9/1996 Simpson et al. ..... 347/187

FOREIGN PATENT DOCUMENTS 0558078 9/1992 European Pat. Off. ..... 347/187

*Primary Examiner*—Huan H. Tran

*Attorney, Agent, or Firm*—Sughrue, Mion, Zinn, Macpeak & Seas, PLLC

[57] ABSTRACT

A heat-sensitive recording material which develops color in a density according to heat energy supplied thereto is pre-heated by supplying the heat-sensitive recording material with heat energy less than color developing heat energy and information is recorded on the recording material by supplying predetermined color developing heat energy to the heat-sensitive recording material according to the information to be recorded. After the information is recorded, the recording material is rapidly cooled by a cooling block which is disposed in the recording position or the vicinity of the recording position downstream thereof.

3 Claims, 4 Drawing Sheets

THERMAL RECORDING DEVICE

BACKGROUND OF THE INVENTION

1. Field of the Invention

This invention relates to a thermal recording device for recording an image or the like on a heat-sensitive recording medium by applying predetermined heat energy thereto with the recording medium pre-heated.

2. Description of the Related Art

There has been put into wide use a thermal recording device which records an image or the like on a heat-sensitive recording medium by applying heat energy to the recording medium. Recently there has been developed a thermal recording device in which a laser is employed as a heat source, thereby making it feasible to effect high speed recording. See, for instance, Japanese Unexamined Patent Publication Nos. 50(1975)-23617, 58(1983)-94494, 62(1987)-77983 and 62(1987)-78964.

We have disclosed a heat-sensitive recording material which is used in such a thermal recording device and on which a high quality image can be recorded. The heat-sensitive recording material comprises a color forming agent, a developing agent and a light absorbing dyestuff (photo-thermo conversion agent) provided on a support film and forms a color in a density according to the heat energy applied. See Japanese Unexamined Patent Publication Nos. 5(1993)-301447 and 5(1993)-24219.

The heat-sensitive recording material has a heat sensitive layer formed by applying, to a support film, coating liquid containing therein emulsion obtained by dissolving micro-capsules containing at least a basic dye precursor, a developing agent and a light absorbing dyestuff in organic solvent which is insoluble or slightly soluble in water and then emulsifying the solution.

As the basic dye precursor, is employed a compound which is generally substantially colorless, is colored by donating electrons or accepting protons of acid or the like and has a partial framework of lactone, lactam, sultone, spiro-pyran, ester, amide or the like and in which ring opening or cleavage of the partial framework occurs upon contact with a developing agent. For example, crystal violet lactone, benzoyl leuco methylene blue, malachite green lactone, rhodamine B lactam, 1,3,3-trimethyl-6'-ethyl-8'-butoxyindolinonebenzospiropyran and the like can be used.

As the developing agent for these color forming agents, acidic compounds such as phenol compounds, organic acids, metal salts of organic acids, oxybenzoate esters or the like are employed. As the developing agent, those having a melting point in the range of 50° to 250° C. are preferred, and phenols or organic acids which are slightly soluble in water and have a melting point in the range of 60° to 200° C. are especially preferred. The examples of the developing agent are disclosed, for instance, in Japanese Unexamined Patent Publication No. 61(1986)-291183.

As the light absorbing dyestuff, those having a low light absorption coefficient to visible light and an especially high light absorption coefficient to wavelengths in the infrared region are preferred. For example, cyanine dyestuffs, phthalocyanine dyestuffs, pyrylium and thiopyrylium dyestuffs, azulenium dyestuffs, squarylium dyestuffs, metal complex dyestuffs such as of Ni or Cr, naphthoquinone and anthraquinone dyestuffs, indophenol dyestuffs, indoanyline dyestuffs, triphenylmethane dyestuffs, triarylmethane dyestuffs, aminium and diimmonium dyestuffs and nitroso compounds can be used. Among these compounds, those having a high absorption coefficient to light in near infrared region having wavelengths of 700 to 900 nm are especially preferred in view of the fact that semiconductor lasers oscillating near infrared rays have been put into practice.

Such heat-sensitive recording material is arranged not to be colored at a low energy level in order to ensure good shelf stability. Accordingly in order to obtain a desired color development, a substantial heat energy is necessary. This gives rise to a problem that the dynamic range is narrowed by an amount corresponding to the threshold heat energy necessary to color the recording material and it becomes difficult to obtain a high gradation image. Further load on the recording system required to color the recording material becomes substantial.

Accordingly this applicant has proposed a thermal recording method which can record a high gradation image with a high accuracy without necessity of high output by pre-heating the aforesaid heat-sensitive recording material to a temperature just below the color developing temperature by use of a heat roll or the like and projecting onto the recording material a laser beam modulated according to information to be recorded. See Japanese Unexamined Patent Publication No. 6(1994)-198924.

In such a thermal recording method, the pre-heating temperature should be as high as possible in order to improve the color forming sensitivity of the heat-sensitive recording material. However, unlike localized heating of the heat-sensitive layer of the heat-sensitive recording material by the laser beam for recording, the pre-heating of the recording material is effected over entire recording material including the support sheet and accordingly the temperature T of the heat-sensitive recording material slowly lowers with time t as shown in FIG. 7 by spontaneous heat dissipation after the end of recording by the laser beam. Accordingly since the heat-sensitive recording material is kept at a temperature higher than a predetermined temperature for a substantially long time, fogging can occur, that is, the ground density increases.

For example, heat-sensitive recording materials for medical use which are required to be tough to such an extent that permits them to be mounted on a lightbox should be large in thickness. In the case of such a thick heat-sensitive recording material, it takes a long time for the recording material to cool off by spontaneous heat dissipation and accordingly fogging are more apt to occur. Thus it has been difficult to pre-heat such a thick heat-sensitive recording material to a high temperature.

SUMMARY OF THE INVENTION

In view of the foregoing observations and description, the primary object of the present invention is to provide a thermal recording device which permits setting the pre-heating temperature high and permits efficient recording at low cost.

In a thermal recording device which records information on a heat-sensitive recording material which develops color in a density according to heat energy supplied thereto by pre-heating the heat-sensitive recording material with heat energy less than color developing heat energy necessary to develop color in the heat-sensitive recording material and supplying predetermined color developing heat energy to the heat-sensitive recording material according to the information to be recorded, the thermal recording device in accordance with the present invention is characterized by a pre-heating means which supplies heat energy less than the color developing heat energy to the heat-sensitive recording material and is disposed upstream of a recording position where a recording means supplies developing heat energy to the heat-sensitive recording material, and a cooling means which is disposed in said recording position or the vicinity of the recording position downstream thereof and cools the heat-sensitive recording material.

In the thermal recording device of this embodiment, information is recorded on the heat-sensitive recording material by the recording means with the recording material heated to a pre-heating temperature just below the color developing temperature and then the recording material is forced to rapidly cool by the cooling means, whereby occurrence of fogging is prevented. Accordingly, the pre-heating temperature can be as high as possible, which ensures a wide dynamic range of the recording means and permits high speed recording.

The cooling means may be disposed in the recording position. Since the heat-sensitive recording material is conveyed, the recording material is not cooled as soon as the recording material is brought to the recording position and is kept at the pre-heating temperature in the recording position even if the cooling means is disposed in the recording position.

DESCRIPTION OF THE PREFERRED EMBODIMENT

Figure 1:
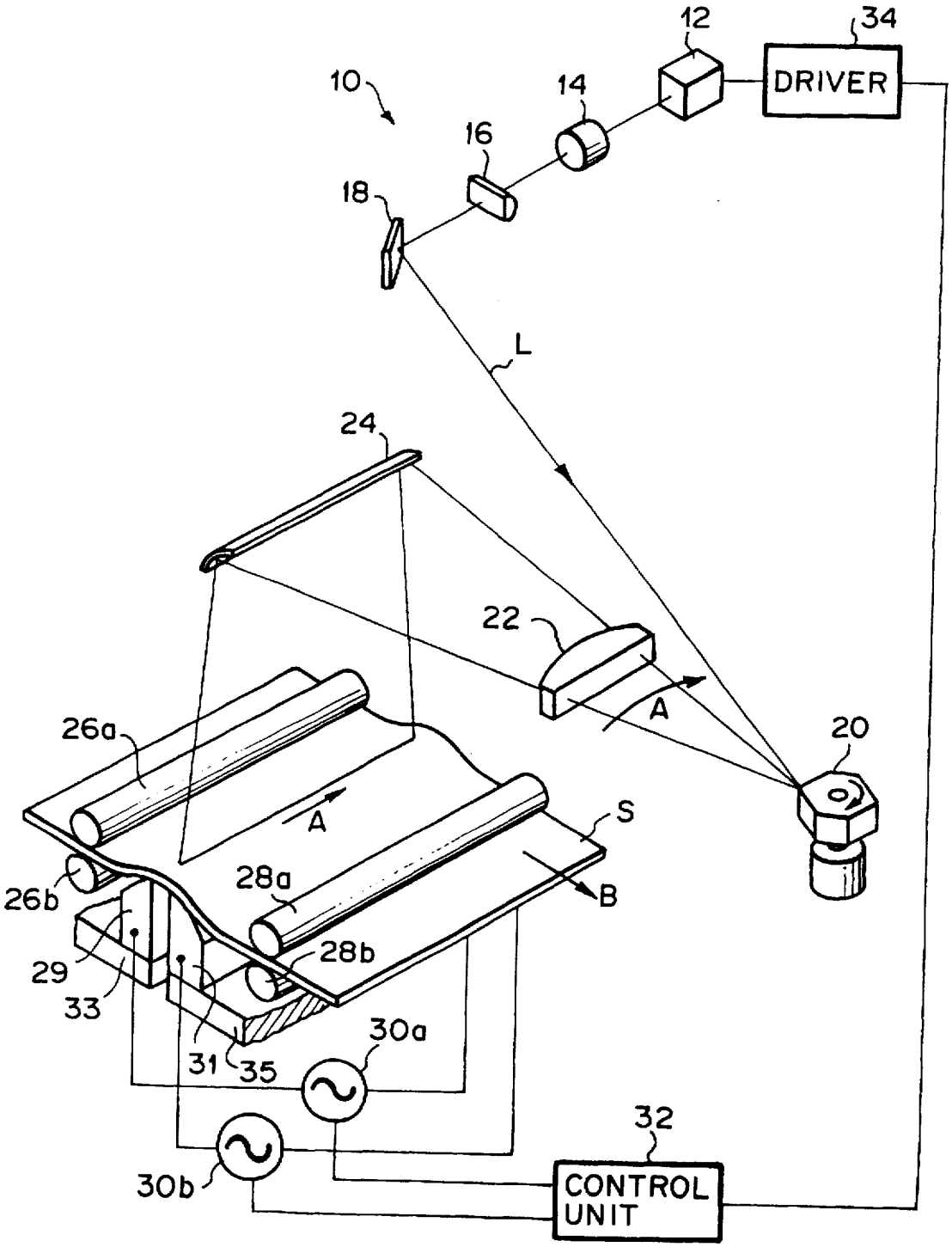
FIG. 1 is a schematic perspective view of a thermal recording device in accordance with an embodiment of the present invention.

In FIG. 1, a thermal recording device 10 in accordance with an embodiment of the present invention is for recording an image on a heat-sensitive recording material S by scanning the heat-sensitive recording material S with a laser beam L in the direction of arrow A (main scanning) while conveying the heat-sensitive recording material S in the direction of arrow B (subscanning). The thermal recording device 10 comprises a laser diode 12 which outputs a laser beam L, a collimator lens 14 which collimates the laser beam L, a cylindrical lens 16, a reflecting mirror 18, a polygonal mirror 20 which deflects the laser beam L, an fθ lens 22, a cylindrical mirror 24 which is associated with the cylindrical lens 16 to compensate for surface tilt in deflecting surfaces of the polygonal mirror 20, two pairs of nip rolls 26*a*, 26*b*, 28*a* and 28*b* for conveying the heat-sensitive recording material S in the sub-scanning direction, a pre-heating block 29 and a cooling block 31 which are disposed between the nip rolls 26*a* and 26*b* and the nip rolls 28*a* and 28*b* and adapted to abut against the heat-sensitive recording material S on the side opposite to the laser beam L, a power source 30*a* which energizes the pre-heating block 29 and heats the pre-heating block to a pre-heating temperature and a power source 30*b* which energizes the cooling block 31 and cools the cooling block 31 to a cooling temperature. The power sources 30*a* and 30*b* are controlled by a control unit 32 and the laser diode 12 is controlled by the control unit 32 by way of a driver 34.

Figure 2:
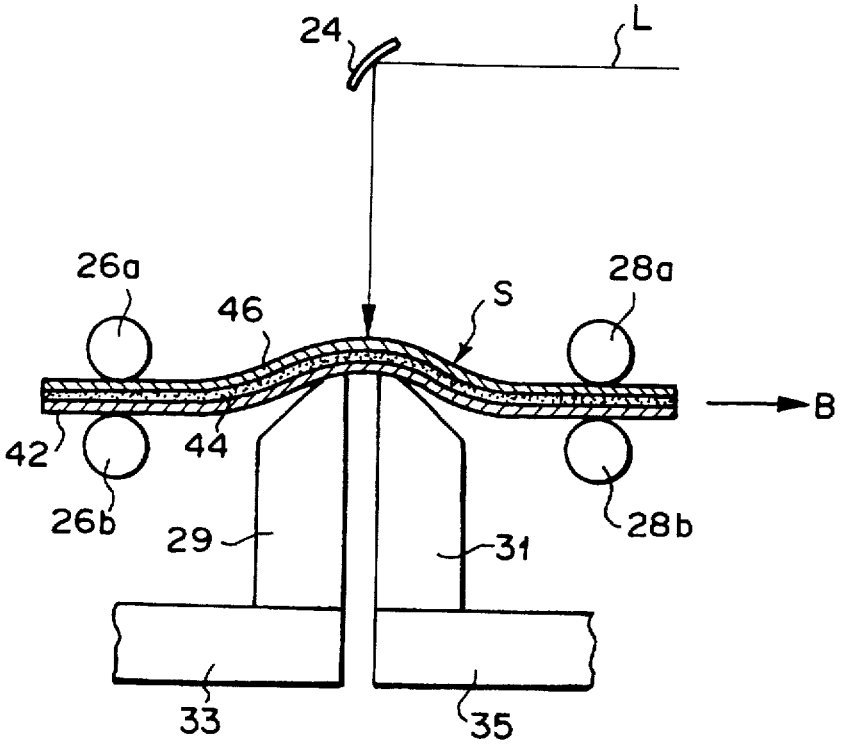
FIG. 2 is a view for illustrating the heat-sensitive recording material and the portion near the recording position in the thermal recording device shown in FIG. 1.

As shown in FIG. 2, the pre-heating block 29 is of a block body which is disposed upstream of the recording position (on the side of the recording position near the nip rolls 26*a* and 26*b*), where the laser beam L impinges upon the heat-sensitive recording material S, at a predetermined distance therefrom. The pre-heating block 29 abuts against the recording material S at an edge portion 29*a* which is narrow in the sub-scanning direction. The cooling block 31 is a metal block which is disposed downstream of the recording position (on the side of the recording position near the nip rolls 28*a* and 28*b*) at a predetermined distance therefrom. The cooling block 31 abuts against the recording material S at an edge portion 31*a* which is similar to the edge portion 29*a* of the pre-heating block 29. The pre-heating block 29 is supported on the thermal recording device 10 by way of a thermal insulating member 33 in order to prevent dissipation of heat energy and the cooling block 31 is supported on the thermal recording device 10 by way of a metal member 35 having a high thermal conductivity in order to effectively dissipate heat energy.

The heat-sensitive recording material S comprises a heat-sensitive layer 44 which contains therein a color forming agent, a developing agent and a photo-thermo conversion agent and is formed on a support film 42 and a protective layer 46 formed on the heat-sensitive layer 44. As the materials of the heat-sensitive layer 44, those disclosed, for instance, in Japanese Unexamined Patent Publication Nos. 5(1993)-301447 and 5(1993)-24219 may be employed.

Figure 3:
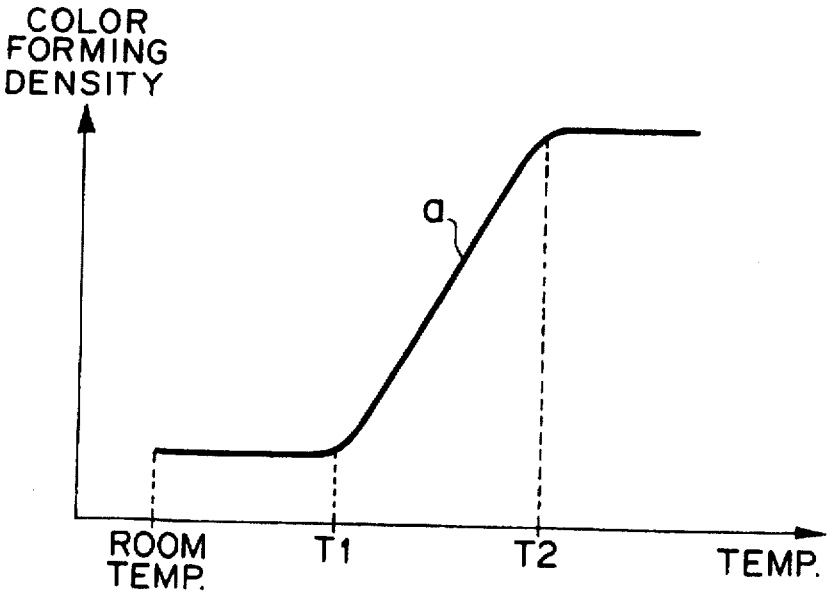
FIG. 3 is a view for illustrating the color developing characteristics of the heat-sensitive recording material.

The control unit 32 actuates the power source 30*a* to pre-heat the heat-sensitive recording material S while conveying the heat-sensitive recording material S in the direction of arrow B (sub-scanning) with the recording material S nipped between the nip rolls 26*a* and 26*b* and between the nip rolls 28*a* and 28*b*. That is, a predetermined electric current is supplied to the preheating block 29 from the power source 30*a* and the heat-sensitive recording material S is heated to a temperature just below a color developing temperature. The curve a in FIG. 3 shows the relation between the temperature of the heat-sensitive recording material S and the density of color developed. The heat-sensitive recording material S is pre-heated to a temperature T1 just below a temperature at which color begins to be developed.

With the heat-sensitive recording material S pre-heated by the heat roll 28 in this manner, the control unit 32 drives the laser diode 12 by way of the driver 34. The laser diode 12 outputs a laser beam L modulated according to the gradation of an image to be recorded on the heat-sensitive recording material S. The laser beam L is collimated by the collimator lens 14 and impinges upon the polygonal mirror 20 through the cylindrical lens 16 and the reflecting mirror 18. The polygonal mirror 20 is rotating at a high speed and the laser beam L is deflected by the polygonal mirror 20 to impinge upon the heat-sensitive recording material S through the fθ lens 22 and the cylindrical mirror 24, thereby scanning the heat-sensitive recording material S in the direction of arrow A (main scanning) while the recording material S is being conveyed in the sub-scanning direction. As a result, predetermined heat energy is applied to the heat-sensitive layer 44 of the heat-sensitive recording material S by the laser beam L, whereby a gradation image or the like is recorded on the recording material S.

Since the heat-sensitive recording material S has been pre-heated to the temperature T1 (FIG. 3) by the pre-heating block 29, the laser diode 12 need not be controlled in a wide temperature range between the room temperature of the place where the thermal recording device 10 is installed and the temperature T2 shown in FIG. 3. That is, the laser diode 12 is controlled in the temperature range between the temperatures T1 and T2 and a high gradation image can be recorded on the heat-sensitive recording material S. Further since the laser diode 12 need not output high power, the thermal recording device 10 can be simplified in structure and can be manufactured at low cost. It is preferred that the temperature T1 be set between 40° C. to 275° C. according to the color developing properties of the heat-sensitive recording material S. More preferably the temperature T1 is set between 70° C. to 150° C. since the glass transition temperature of the microcupusles is 70° C. to 150° C.

The heat-sensitive recording material S on which an image or the like has been recorded is cooled rapidly by the cooling block 31 disposed downstream of the recording position. The solid line in FIG. 4 shows the change in temperature of the heat-sensitive recording material S, where the recording material S is heated to the pre-heating temperature T1 by the pre-heating block 29 at time t1, to the recording temperature by the laser beam L at time t2 and is rapidly cooled by the cooling block 31 at time t3.

Figure 4:
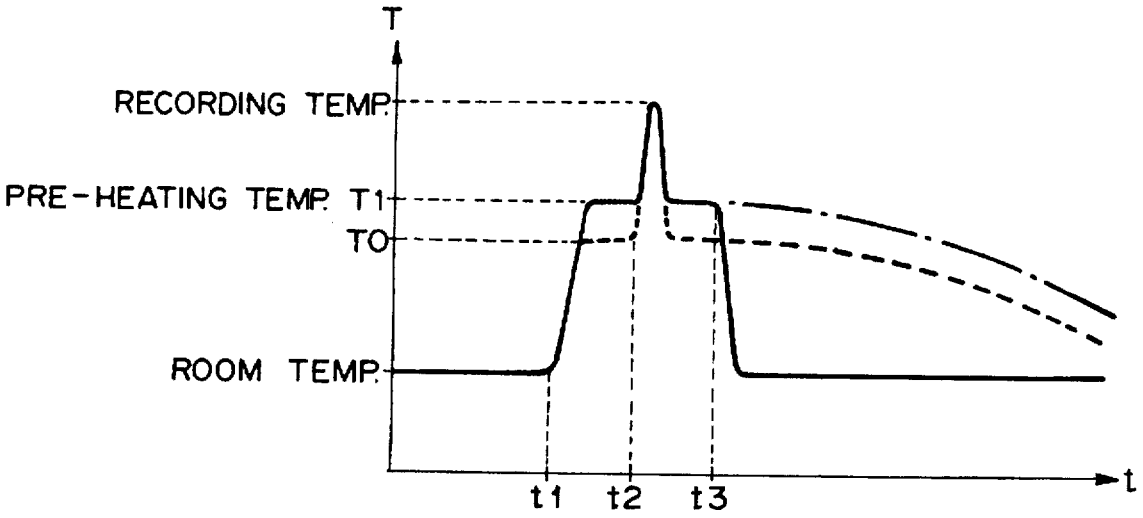
FIG. 4 is a view for illustrating the change in the temperature of the heat-sensitive recording material.

When the heat-sensitive recording material S is not forced to cool, fogging appears on the recording material S due to residual heat after the time T3 as shown by the chained line in FIG. 4 if the recording material is pre-heated to the temperature T1. Accordingly the pre-heating temperature must be lowered to temperature T0 as shown by the dotted line in FIG. 4. To the contrast, in the thermal recording device 10 of this embodiment, the color forming density cannot increase to cause fogging since the recording material S is rapidly cooled after the time t3. Thus in this embodiment, a high quality image can be recorded without fogging after recording even if the heat-sensitive recording material is pre-heated to the temperature T1 just below the color developing temperature. Further a maximum dynamic range of the laser beam L can be ensured, whereby an inexpensive laser diode 12 can be used. Further since the recording material S can be pre-heated to a high temperature, the sensitivity of the recording material S is increased, which results in a higher recording speed and a higher recording efficiency.

In this embodiment, when the time from the pre-heating at the pre-heating block 29 and the recording by the laser beam L is set with a predetermined range, heat energy is sufficiently transmitted to the heat-sensitive layer 44 and temperature drop due to spontaneous heat dissipation after the pre-heating can be suppressed, whereby recording can be effected more accurately within a desirable temperature range. The time can be set depending on the distance between the pre-heating position and the recording position and/or the conveying speed of the heat-sensitive recording material S. The cooling block 31 may be disposed in the recording position. Further, the cooling block 31 has only to cool the recording material to prevent occurrence of fogging and accordingly the accuracy in temperature setting need not be so high as that for the pre-heating block 29.

Figure 5:
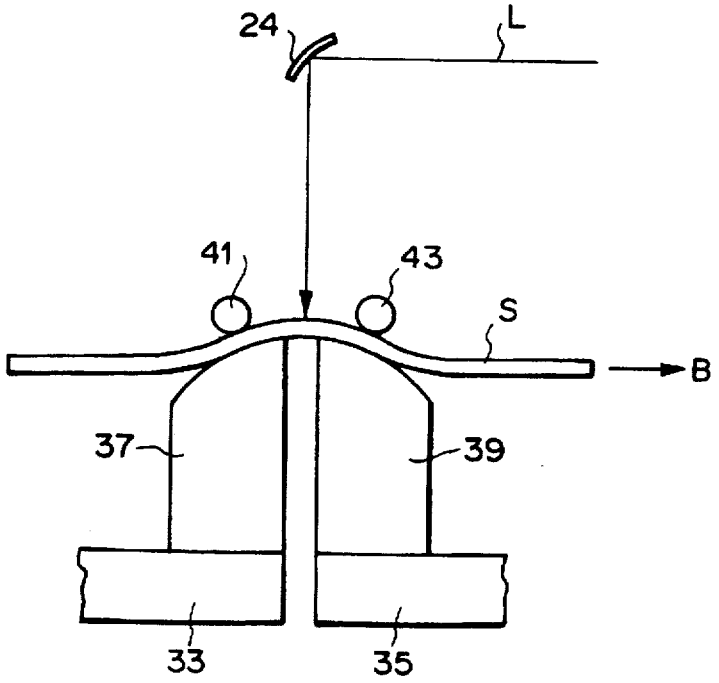
FIG. 5 is a view for illustrating the heat-sensitive recording material and the portion near the recording position in a thermal recording device in accordance with another embodiment of the present invention.

FIG. 5 shows another embodiment of the present invention. In this embodiment, the surfaces of the pre-heating block 37 and the cooling block 39 are arcuate and the heat-sensitive recording material S is pressed against the pre-heating block 37 and the cooling block 39 respectively by rollers 41 and 43. This arrangement is advantageous in that since the heat-sensitive recording material S can be conveyed firmly held by the rollers 41 and 43 and the blocks 37 and 39, recording can be effected with a high accuracy without affected by vibration or the like. Further by disposing the roller 43 on the downstream side as seen in the direction of conveyance of the heat-sensitive recording material S, the length by which the heat-sensitive recording material S is kept in contact with the cooling block 39 can be longer and accordingly the recording material S is cooled more rapidly, whereby fogging can be more surely prevented.

Figure 6:
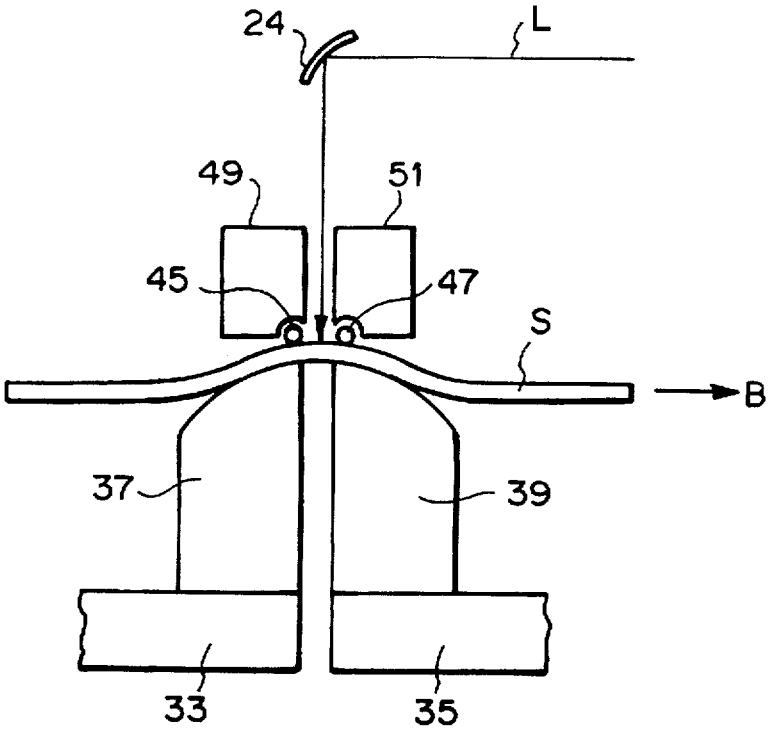
FIG. 6 is a view for illustrating the heat-sensitive recording material and the portion near the recording position in a thermal recording device in accordance with still another embodiment of the present invention.
Figure 7:
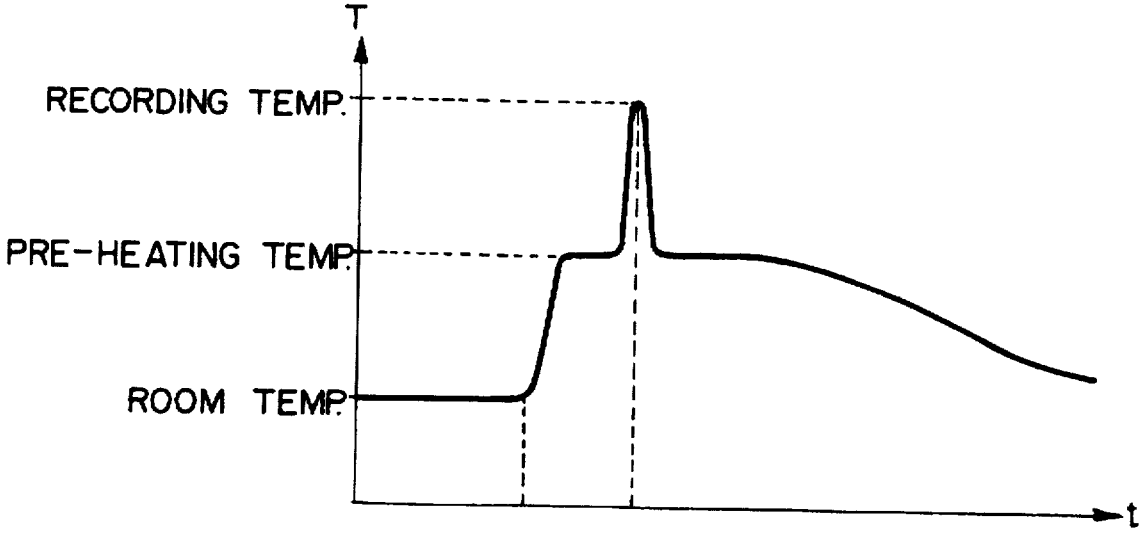
FIG. 7 is a view for illustrating the change in the temperature of the heat-sensitive recording material when the recording material is not forced to cool after recording.

In a still another embodiment shown in FIG. 6, rollers 45 and 47 having a smaller diameter are used. Such smaller diameter rollers 45 and 47 can be held, for instance, by holders 49 and 51 shown in FIG. 6. Also in this embodiment, the heat-sensitive recording material S can be conveyed firmly held by the rollers 45 and 47 and the blocks 37 and 39 and recording can be effected with a high accuracy. Further since the rollers 45 and 47 are small in diameter, the distance between the rollers 45 and 47 can be set small and accordingly the time from beginning of pre-heating to recording by the laser beam L can be shortened, which permits to set the pre-heating temperature higher and to increase the recording efficiency. When a larger diameter roller such as the roller 43 shown in FIG. 5 is used instead of the small diameter roller 47 in order to press the heat-sensitive recording material S against the cooling block 39, the length by which the heat-sensitive recording material S is kept in contact with the cooling block 39 can be enlarged and the cooling efficiency can be increased.

Further when the heat-sensitive recording material S is cooled by the cooling block 39 to a temperature not higher than the glass transition temperature of the support film 42, curl in the heated heat-sensitive recording material S can be removed and the recording material S can be held flat while the recording material S is conveyed and cooled sandwiched between, for instance, the cooling block 39 and the roller 43, whereby the recording material S can be discharged from the recording device 10 in an excellent state.

Recording may be effected using a thermal head instead of the laser diode 12 employed in the embodiments described above.

As can be understood from the description above, in the thermal recording device in accordance with the present invention, information is recorded on the heat-sensitive recording material by the recording means with the recording material heated to a pre-heating temperature just below the color developing temperature and then the recording material is forced to rapidly cool by the cooling means, whereby occurrence of fogging is prevented. Since there is no fear of fogging, the pre-heating temperature can be as close to the color developing temperature as possible, which ensures a wide dynamic range of the recording means and permits high speed recording. Thus, in accordance with the present invention, recording efficiency can be sufficiently improved.

What is claimed is:

1. A thermal recording device for recording information on a heat-sensitive recording material, said recording material comprising a color forming agent, a developing agent and a light absorbing dyestuff, which develops color in a density according to heat energy supplied thereto, by supplying predetermined color developing heat energy to the heat-sensitive recording material according to the information to be recorded, said device comprising:

a pre-heating means which supplies pre-heat energy which is less than the color developing heat energy, to the heat-sensitive recording material and is disposed upstream of a recording position where a recording means supplies developing heat energy to the heat-sensitive recording material; and a cooling means which is disposed in said recording position or the vicinity of the recording position downstream thereof and cools the heat-sensitive recording material; and at least one of the following:

said pre-heating means includes a heating block which transfers said pre-heat energy to said heat-sensitive recording material and is stationary relative to movement of said recording material; and said cooling means includes a cooling block which cools said heat-sensitive recording material to a temperature below the glass transition temperature of said recording material and is stationary relative to movement of said recording material.

2. A thermal recording device as defined in claim 1, wherein said pre-heating means comprises said heating block which is brought into contact with the heat-sensitive recording material and said cooling means comprises said cooling block which is brought into contact with the heat-sensitive recording material.

3. A thermal recording device defined in claim 1, further comprising rollers for bringing said heat-sensitive recording material into contact with said pre-heating means and said cooling means.

* * * * *